US005823834A

United States Patent [19]

Straeb et al.

[11] Patent Number: 5,823,834

[45] Date of Patent: Oct. 20, 1998

[54] FLAT PLUG

[75] Inventors: Martin Straeb, Hassloch; Andreas Hamburger, Hagenbach, both of Germany

[73] Assignee: Siemens Aktiengesellschaft, Munich, Germany

[21] Appl. No.: 631,612

[22] Filed: Apr. 10, 1996

[30] Foreign Application Priority Data

Apr. 10, 1995 [DE] Germany ..... 195 13 590.3

[51] Int. Cl.[6] ..... H01R 9/24

[52] U.S. Cl. ..... 439/884; 439/866

[58] Field of Search ..... 439/866, 825, 439/601, 884

[56] References Cited

U.S. PATENT DOCUMENTS

| | | | |
|---|---|---|---|
| 4,992,064 | 2/1991 | Steinhardt et al. | 439/595 |
| 5,207,603 | 5/1993 | Peloza | 439/884 |

FOREIGN PATENT DOCUMENTS

| | | |
|---|---|---|
| 2 246 988 | 5/1975 | France . |
| 38 04 977 A1 | 8/1989 | Germany . |
| 89 02 967.4 | 8/1990 | Germany . |
| 42 00 109 A1 | 7/1993 | Germany . |

*Primary Examiner*—Neil Abrams
*Assistant Examiner*—T. C. Patel
*Attorney, Agent, or Firm*—Herbert L. Lerner; Laurence A. Greenberg

[57] ABSTRACT

A flat plug includes a base body having a first and a second end, a terminal part integrally connected to the first end of the base body, and a contact blade having two blade halves integrally connected to the second end of the base body. The two blade halves have a broad side, an outer contour and a longitudinal axis. The blade halves are mutually symmetrical about the longitudinal axis with respect to the outer contour. Additionally, the broad side of the two blade halves rest flat against one another in a folded state, whereas the two blade halves are spaced apart from one another along the longitudinal axis in an unfolded state.

16 Claims, 4 Drawing Sheets

FLAT PLUG

BACKGROUND OF THE INVENTION

Field of the Invention

The invention relates to a flat plug, having two blade halves, forming a contact blade, each integrally bound to one end of a base body and having a terminal part formed integrally onto the other end of the base body.

Flat plugs of that kind are widely known and generally have a contact blade. In order to enable the contact blade to enter satisfactorily between the legs of a bent contact spring, dome-shaped dimples or inlet inclines are often provided on the contact blades. A primary field of application of such known flat plugs with a contact blade is their use as a motor vehicle plug connector.

In the automotive field, flat plug contacts with dimensions of 2.8×0.8 mm are very widely used. As a rule, the known flat plugs are high-grade contacts which are exposed to severe conditions in use. The flat plug contacts must have low current-flow resistance, high mechanical stability due to the required slip-proofness, and virtually constant contact forces. The flat plug must also withstand major retention forces, in order to protect the flat plug contact against being pulled out of the associated housing.

Increasingly, two independent securing principles are demanded, which necessitate a special construction of a flat plug. In addition to a so-called primary detent locking, increasingly secondary securing of the flat plug is also demanded. The primary detent locking is typically achieved with detent elements, such as detent tongues, disposed on the flat plug.

Once the flat plugs have been inserted into associated housings made of insulating material (contract strips, relay sockets, and so forth), these detent elements engage corresponding openings of these housings and lock into place there.

In the event that the detent elements on the flat plug are broken off or twisted, for instance, so that secure primary locking of the flat plug in the associated housing is no longer possible, a second securing device, known as secondary security, is provided, which keeps the flat plug inside the housing independent of the primary locking. The secondary security is typically achieved in such a way that once the housing has been equipped with the flat plugs and the contacts have undergone the associated primary locking, plastic elements on the housing are put into a position in which they engage the contours of the flat plug from behind. Due to the symmetrical construct of the flat plugs, these plastic elements can usually engage only one side of the flat plug.

Currently known flat plugs achieve the primary locking and the secondary security through the use of a separation of their electrical and mechanical functions. The high conductance demanded, or in other words large line cross sections, is typically realized by providing that the two blade halves rest flatly on one another to form the contact blade of the flat plug and by integrally joining the two blade halves both to one another along their lengthwise side and to the base body of the flat plug. Due to this construct, a central, symmetrical configuration of the blade halves in relation to the base body is usually impossible.

The two independently acting securing principles of primary locking and secondary securing are, therefore, often accomplished by providing that the flat plug has a bottom spring over which a top spring, also known as a detent spring or detent sleeve, is slipped. In order to provide the primary locking, detent elements are provided on the top spring, which sits clampingly on the bottom spring. The detent elements can lock into corresponding openings of the associated housings of the flat plug. In these known flat plugs, only the rear side of the top spring, toward the connection part and in general the crimp side can act as an operative surface for a secondary securing device. An engagement of the plastic elements disposed in the housing as a secondary securing device is usually not possible on all four sides of the flat plug, because of the construct of the bottom spring.

SUMMARY OF THE INVENTION

It is accordingly an object of the invention to provide a flat plug, which overcomes the hereinafore-mentioned disadvantages of the heretofore-known methods and devices of this general type and which enables engagement of a secondary securing device on all four sides of the flat plug.

With the foregoing and other objects in view there is provided, in accordance with the invention, a flat plug, comprising: a base body having a first and a second end; a terminal part integrally connected to the first end of the base body; and a contact blade having two blade halves integrally connected to the second end of the base body, the two blade halves having a longitudinal axis and an outer contour, the blade halves being mutually symmetrical about the longitudinal axis with respect to the outer contour, each of the two blade halves having a broad side, the broad side of the two blade halves resting flat against one another in a folded state, and the two blade halves being spaced apart from one another along the longitudinal axis in an unfolded state.

As a result of the spacing of the two blade halves in the developed or unfolded state, construction options become available which make it possible to create a flat plug that is symmetrically constructed in all directions, with possibilities of engagement on all sides for a secondary securing device.

In a further feature of the invention it is provided that the base body, in the folded state of the flat plug, be provided with an approximately U- or V-shaped cross section; on one end of the base body, preferably through a narrowed blade half neck, the two blade halves extend spaced apart from one another in the direction of the insertion end of the flat plug, and on the other side of the base body two ribs are integrally formed thereon in the direction of the terminal part. The two ribs formed onto the base body extend, spaced apart from one another, toward the terminal part of the flat plug, and the ribs are bound to the base body in such a way that in the folded state of the flat plug and, thus, in the folded state of the base body, two outer edges extend beyond the two ribs, and a U- or V-shaped outer edge of the base body adjoins beneath the ribs. These edges that extend beyond where the ribs are bound can be engaged on all sides by plastic elements.

In accordance with an added feature of the invention, each of the two blade halves is symmetrical defining center lines extending parallel to the longitudinal axis. This assures that the flat plug, even rotated by 180, can be inserted into an associated contact spring.

In accordance with an additional feature of the invention, each of the two blade halves includes a neck and a remaining portion, each of the necks being connected to the base body and being narrower than each of the remaining portions. As a result, the requisite bending forces that are necessary in order to press the two blade halves connected to the base body flatly against one another are reduced.

In accordance with another feature of the invention, the base body, and preferably the entire flat plug, is disposed symmetrically about the longitudinal axis. The result is a particularly simple shape of the metal part cut apart from a developed view of a metal strip.

In accordance with a further feature of the invention, the base body has a U-shaped or V-shaped cross-section in the folded state and the base body includes base body halves, at least one of the base body halves having at least one detent element disposed thereon.

In order to reduce the overall production cost of the flat plug, the flat plug of the invention is advantageously constructed in such a way that a top spring or detent sleeve can be dispensed with. The detent elements for the primary locking are preferably integrated with the base body of the flat plug of the invention.

In accordance with again an added feature of the invention, the at least one detent element is two detent elements extending outwardly on the base body halves, the detent elements being tabs formed by U-shaped or V-shaped notches in the base body being bent outward to protrude into notches.

In accordance with again an additional feature of the invention, the contact blade, the base body and the terminal part are constructed from a metal strip.

In accordance with again another feature of the invention, the base body, in the unfolded state, has a quadrilateral outer shape with four outer edges, two of the outer edges extending parallel to the longitudinal axis, and two of the outer edges extending orthogonally to the longitudinal axis. If the outer edge toward the terminal part of the flat plug is extended both between the two ribs connecting the terminal part and the base body and beyond these two ribs, then it is possible in a simple way, in the folded state of the flat plug, to make secondary securing elements engage these protruding edges on all sides.

In order to achieve the best possible conductance of the flat plug of the invention, the two blade halves that form the contact blade not only rest flatly on one another but are also joined together in a form- or material-locking manner. This joining can be achieved, for instance, in that the two blade halves are soldered or welded together or are adhesively connected with an electrically conductive adhesive.

In accordance with again a further feature of the invention, one of the blade halves has a retaining arm clamping the two blade halves together by surroundingly engaging in the other of the blade halves or by engaging beneath the other of the blade halves.

In accordance with yet an added feature of the invention, the other blade half has a first tab disposed thereon; the one blade half has an edge; and the retaining arm is a second tab being attached to the edge, being back 180° toward the one blade half and being engaged from beneath by the first tab, defining flush surfaces of the contact blade. Preferably, each of the two blade halves is constructed with a retaining arm, and the other blade half is each provided with a tab that fits engagingly under this retaining arm.

In accordance with yet an additional feature of the invention, one blade half has at least one bead formed thereon and the other blade half has at least one bore formed therein corresponding to the at least one bead, the at least one bead being pressed into the at least one bore in the folded state to join the two blade halves. As a result, a clamping connection of the two blade halves is once again attained.

Other features which are considered as characteristic for the invention are set forth in the appended claims.

Although the invention is illustrated and described herein as constructed in a flat plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 7 is a side-elevational view of the flat plug showing V-shaped notches; and FIGS. 8*a* and 8*b* are cross-sectional views showing a V-shaped and U-shaped body section which is taken along the line I—I of FIG. 1.

DESCRIPTION OF THE PREFERRED EMBODIMENTS

Figure 3:
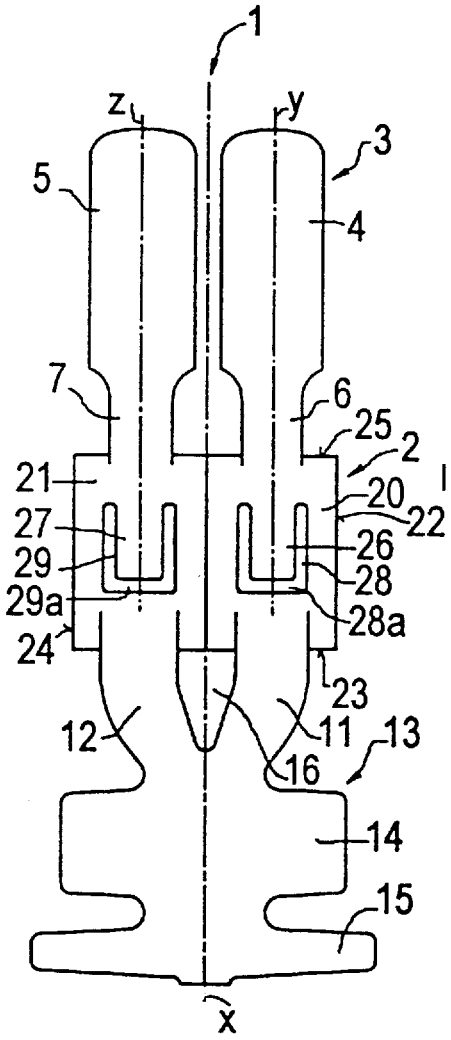
FIG. 3 is a side-elevation view of the flat plug in the folded state.

In the ensuing figures, unless otherwise stated, the same reference numerals designate the same parts with the same meaning.

Figure 1:
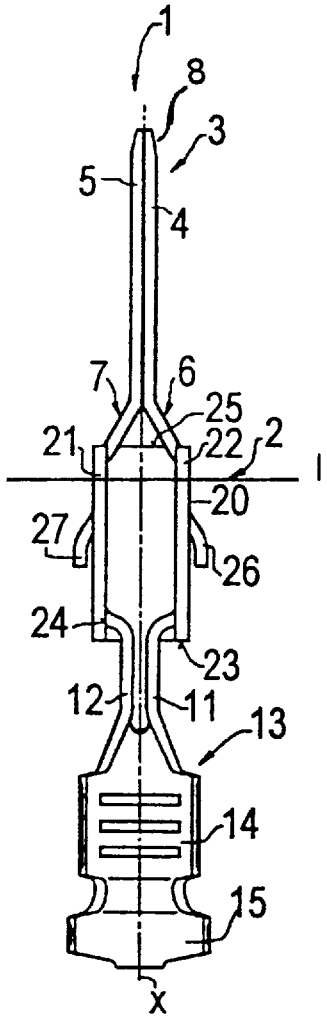
FIG. 1 is a plan view of first preferred embodiment of a flat plug in the folded state according to the invention.

Referring now to the figures of the drawings in detail and first, particularly, to FIG. 1 thereof, there is seen a plan view of a first preferred embodiment of a flat plug in a folded state according to the invention along the plug's longitudinal axis X. The flat plug is identified by reference numeral 1. This flat plug 1 substantially includes a central base body 2 having a front end and a rear end. The front end is integrally attached to a contact blade 3, whereas the rear end is integrally attached to a terminal part 13.

Figure 2:
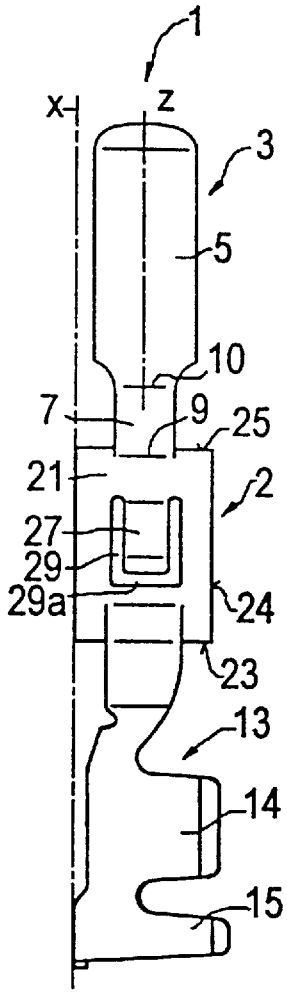
FIG. 2 is a side-elevational view of the flat plug in the folded state.

As can be seen from FIG. 2, which illustrates the side-elevational view of the folded flat plug 1, and from FIG. 3, which illustrates the plan view of the unfolded flat plug 1, the contact blade 3 includes two blade halves 4, 5. When the flat plug 1 is in the folded state, one of the broad sides of blade half 4 flatly rests against a corresponding broad side of the other blade half 5.

As the developed view of the flat plug 1 in FIG. 3 clearly illustrates, the two blade halves 4, 5 are disposed spaced apart from one another over their entire long sides. Moreover, each of the two blade halves 4, 5 is constructed symmetrically with respect to a respective center line Y and Z. The two blade halves 4, 5 are rounded on ends oriented toward the plug insertion side. Moreover, the two blade halves 4, 5 are beveled, tapered to a point, on their front ends, as FIG. 1 illustrates, so that the contact blade 3 may satisfactorily enter between the legs of a contact spring. The point 8 of the contact blade 3 is, therefore, provided with domelike dimples or inlet inclines.

Each of the two blade halves 4, 5 is connected to the base body 2 with respective necks 6, 7. The two blade half necks 6, 7 are narrowed in comparison with the width of the blade halves 4, 5. In the exemplary embodiment of FIGS. 1, 2 and 3, the necks 6, 7 are each disposed symmetrically to the center lines Y, Z and are provided with outer edges extending parallel to these center lines Y, Z. The outer edges of these necks 6, 7 merge with the outer edges of the blade halves 4, 5 by curving at their ends toward the blade halves 4, 5. The two necks 6, 7 of the blade halves are integrally connected with the preferably rectangular base body 2. The base body 2 has two outer edges 22, 24 extending parallel to the longitudinal axis X and two outer edges 23, 25 disposed orthogonally to the longitudinal axis X. The two outer edges 22, 24 are at a somewhat greater distance from the longitudinal axis X of the flat plug 1 than the outer edges of the two blade halves 4, 5. The base body 2 of the flat plug 1 is constructed symmetrically to the longitudinal axis X and has two approximately rectangular base body halves 20, 21. A U-shaped notch 28, 29 is formed in both base body halves 20, 21 and is preferably formed symmetrically to the respective center lines Y and Z. The crosswise legs 28*a* and 29*a* of the notches 28 and 29, respectively, each extend orthogonally to the longitudinal axis X and are oriented toward the terminal part 13 of the flat plug 1. The notches 28, 29 define two tabs 26, 27 in the base body 2, which as FIG. 1 clearly illustrates are bent away from one another in the folded state of the flat plug so that they may be used as detent tongues and, therefore, as a primary securing means of the flat plug 1.

In the alternative, V-shaped notches 28 and 29 as shown in FIG. 7 could be utilized instead of the U-shaped notches.

The two base body halves 20, 21 are each connected with a respective rib 11, 12 to the terminal part 13 of the flat plug 1. The two ribs 11, 12 have approximately the same width as the blade half necks 6, 7 and are likewise disposed symmetrically to the longitudinal axis X. The two ribs 11, 12, beginning at the base body 2, initially extend spaced apart from one another in the direction toward the terminal part 13, then curve toward one another, and end at a widened conductor wire claw 14 with an adjoining insulation claw 15. An opening 16 is, thus, formed between the two ribs 11, 12, as the plan view of FIG. 3 clearly illustrates.

The metal part of FIG. 3, separated from a metal strip, for instance, by stamping, is folded over in an ensuing machining operation in such a way that the flat plug 1 attains the form illustrated in FIGS. 1 and 2. To that end, the two blade halves 4, 5 are joined flatly against one another. The base body 2 is bent into a U or V as shown in FIGS. 8*a* and 8*b*, so that the blade half necks 6, 7 merge together in the direction of the blade halves 4, 5. The base body 2 is bent in such a way that its outer edges 22, 24 preferably extend parallel to the longitudinal axis X. The tabs 26, 27, for primary locking of the flat plug 1, are bent outward, in terms of the longitudinal axis X, from the walls of the base body halves 20, 21 in order to form the detent elements for the primary locking.

The ribs 11, 12 are bent in such a way that they extend approximately parallel to one another in their middle sections and then diverge in a V at the end disposed toward the base body 2. At the other end the ribs 11, 12 diverge from one another in the form of a V and merge with the conductor claw 14 and insulation claw 15, which are each bent into a U shape.

The two blade halves 4, 5 of the contact blade 3 can be joined together in most any fashion, such as gluing, welding, soldering or clamping.

Figure 4A:
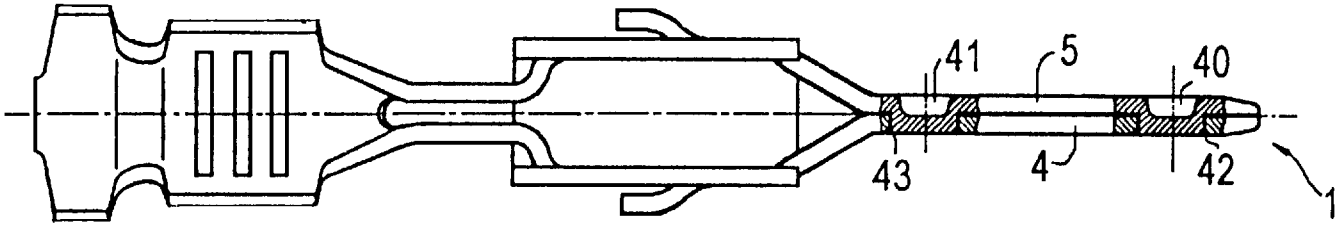
FIG. 4A is a plan view of a second preferred embodiment of a flat plug in the folded state according to the invention.
Figure 4B:
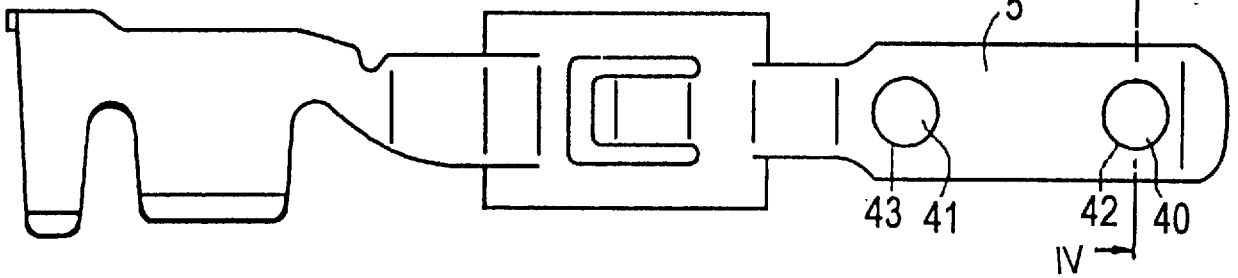
FIG. 4B is a side-elevational view of the second preferred embodiment of the flat plug in the folded state.
Figure 4C:
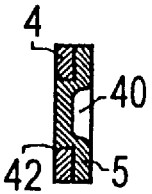
FIG. 4C is a cross-sectional view of the second preferred embodiment of the flat plug in the folded state which is taken along the line IV—IV of FIG. 4B, in the direction of the arrows.

FIGS. 4A–4C illustrate a second embodiment of the flat plug 1 in which the two blade halves 4, 5 are joined, by way of example, with suitable beads and bores in the blade halves 4, 5 of the flat plug 1. The views of the flat plug 1 illustrated in FIGS. 4A and 4B are largely equivalent to the views of the flat plug illustrated in FIGS. 1 and 2, respectively. In addition, FIG. 4A illustrates two beads 40, 41 formed in the blade half 5. Bead 40 is also illustrated in FIG. 4C. The beads 40, 41 in the blade half 5 of the flat plug 1 are pressed clampingly into associated bores 42, 43 formed in the blade half 4. To that end, the beads 40, 41 and the bores 42, 43 are disposed at the same height on the two blade halves 4, 5. The beads 40, 41 are constructed somewhat larger than the bores 42, 43, so that, once the beads 40, 41 have been pressed into the bores 42, 43, a clamping hold of the two blade halves 4, 5 is assured.

In order to provide added clarity, FIG. 4C illustrates a sectional view of the flat plug 1 which is taken along the line IV—IV of FIG. 4B, in the direction of the arrows.

Figure 5A:
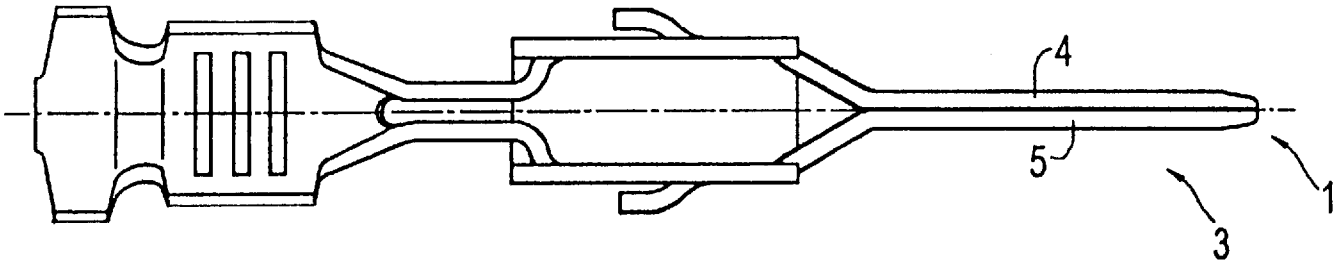
FIG. 5A is a plan view of a third preferred embodiment of a flat plug in the folded state according to the invention.
Figure 5B:
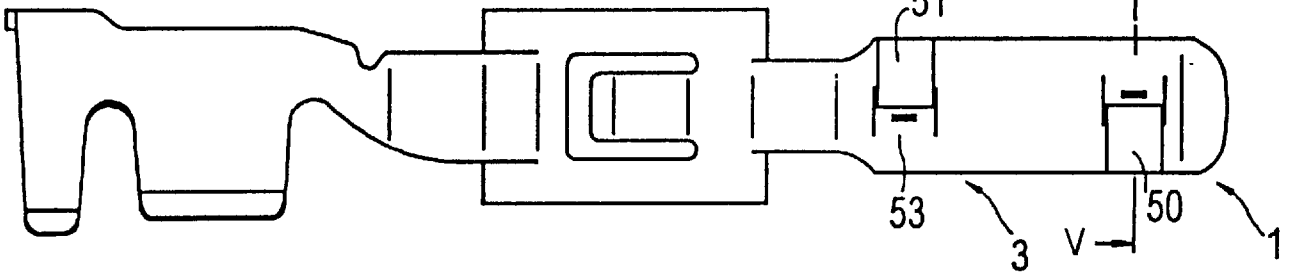
FIG. 5B is a side-elevational view of the third preferred embodiment of the flat plug in the folded state.
Figure 5C:
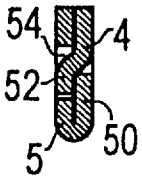
FIG. 5C is a cross-sectional view of the third preferred embodiment of the flat plug in the folded state which is taken along the line V—V of FIG. 5B, in the direction of the arrows.

A third preferred embodiment is illustrated in FIGS. 5A–5C of the flat plug 1 fundamentally already illustrated in FIGS. 1 and 2. The two blade halves 4, 5 are secured to one another in this embodiment by suitable retaining arms 50, 51. To that end, the blade half 5, for instance, is provided peripherally on the front third of the blade half 5 toward the plug insertion end with a retaining arm 50 extending away from it in FIG. 5B, which in the folded state of the flat plug 1 is bent back 180° in the direction of the blade half 5. The blade half 5 is provided, in the region below this bent-back retaining arm 50, with an opening 54, beneath which a tab 52 of the other blade half 4 engages this blade half. The retaining arm 50 and the tab 52 are bent over onto one another in such a way that the contact blade 3 has surfaces that extend flush. In a preferred embodiment of the flat plug, the retaining arms 50, 51 are also tabs.

The disposition of the retaining arm 50 and the tab 52 is also illustrated in the cross-sectional view of FIG. 5C, which is taken along the line V—V of FIG. 5B, in the direction of the arrows.

Preferably, the two blade halves 4, 5 are clampingly joined together by a plurality of retaining arm/tab pairs, represented in the exemplary embodiment of FIG. 5 by two such intermeshing pairs 50, 52 and 51, 53. The retaining arm/tab pair 51, 53 is disposed in the lower third of the contact blade 3 toward the central base body, in the exemplary embodiment of FIGS. 5A–C.

Figure 6A:
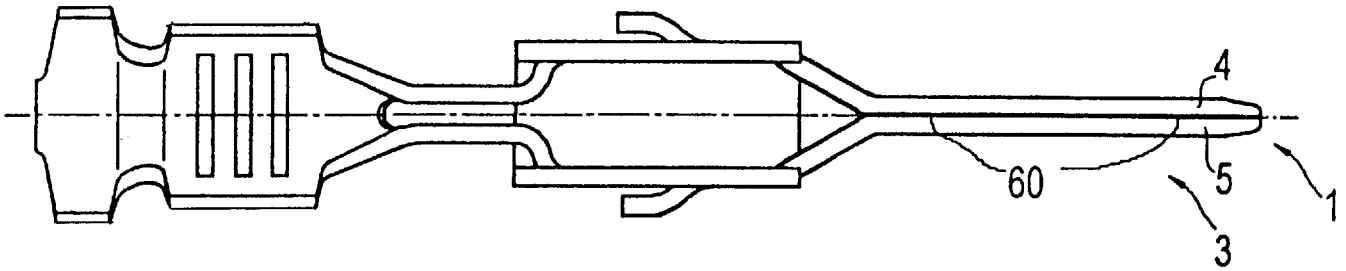
FIG. 6A is a plan view of a fourth preferred embodiment of a flat plug in the folded state according to the invention.
Figure 6B:
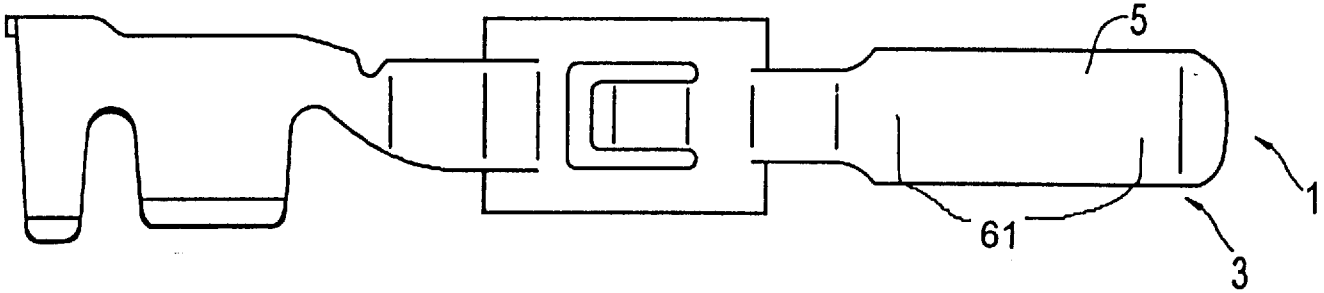
FIG. 6B is a side-elevational view of the fourth preferred embodiment of the flat plug in the folded state.

Moreover, as the views of the flat plug in FIGS. 6A and 6B illustrate, it is also possible to weld the two blade halves 4, 5 of the contact blade 3 together. The welding of the two blade halves 4, 5 can, for instance, be done with a suitable laser. The two blade halves 4, 5 may, for instance, be welded together laterally along their edge, as the weld seam 60 in the plan view of the flat plug 1 of FIG. 6A illustrates.

It is moreover possible to weld the two blade halves 4, 5 together in the region of their broad sides. Possible locations for the weld points are marked with the reference numeral 61 in FIG. 6B.

We claim:

1. A flat plug, comprising:

a base body having a first end, a second end and a width;

said base body having a v-shaped cross-section in a folded state;

a terminal part having terminal ribs integrally connected to said first end of said base body, said terminal ribs having a given width less than said width of said base body; and a contact blade having two blade halves, each of said two blade halves having a neck with a given width less than said width of said base body and integrally connected to said second end of said base body, said two blade halves having a longitudinal axis and an outer contour, said blade halves being mutually symmetrical about said longitudinal axis with respect to said outer contour, said longitudinal axis defining a single folding line for folding the flat plug into the folded state;

each of said two blade halves having a broad side, said broad side of said two blade halves resting flat against one another in the folded state, and said two blade halves being spaced apart from one another along the longitudinal axis in an unfolded state.

2. The flat plug according to claim 1, wherein each of said two blade halves is symmetrical defining center lines extending parallel to the longitudinal axis.

3. The flat plug according to claim 1, wherein each of said two blade halves includes a remaining portion connected to said neck, each of said necks being narrower than each of said remaining portions.

4. The flat plug according to claim 1, wherein said base body is disposed symmetrically about the longitudinal axis.

5. The flat plug according to claim 1, wherein said base body includes base body halves, at least one of said base body halves having at least one detent element disposed thereon.

6. The flat plug according to claim 5, wherein said at least one detent element is two detent elements extending outwardly on said base body halves, said detent elements being tabs formed by U-shaped notches in said base body being bent outward.

7. The flat plug according to claim 5, wherein said at least one detent element is two detent elements extending outwardly on said base body halves, said detent elements being tabs formed by U-shaped notches in said base body being bent outward.

8. The flat plug according to claim 5, wherein said at least one detent element is two detent elements extending outwardly on said base body halves, said detent elements being tabs formed by V-shaped notches in said base body being bent outward.

9. The flat plug according to claim 1, wherein said contact blade, said base body and said terminal part are constructed from a metal strip.

10. The flat plug according to claim 1, wherein said base body, in the unfolded state, has a quadrilateral outer shape with four outer edges, two of said outer edges extending parallel to the longitudinal axis, and two of said outer edges extending orthogonally to the longitudinal axis.

11. The flat plug according to claim 1, wherein said two blade halves are adhesively connected in the folded state.

12. The flat plug according to claim 1, wherein said two blade halves are soldered together in the folded state.

13. The flat plug according to claim 1, wherein said two blade halves are welded together in the folded state.

14. The flat plug according to claim 1, wherein one of said blade halves has a retaining arm clamping said two blade halves together by engaging in the other of said blade halves.

15. The flat plug according to claim 14, wherein said other blade half has a first tab disposed thereon;

said one blade half has an edge; and said retaining arm is a second tab being attached to said edge, being back 180° toward said one blade half and being engaged by said first tab, defining flush surfaces of said contact blade.

16. The flat plug according to claim 1, wherein said one blade half has at least one bead formed thereon and said other blade half has at least one bore formed therein corresponding to said at least one bead, said at least one bead being pressed into said at least one bore in the folded state to join said two blade halves.

* * * * *